US010260279B2

(12) United States Patent
Nakae et al.

(10) Patent No.: US 10,260,279 B2
(45) Date of Patent: Apr. 16, 2019

(54) SCREEN APPARATUS AND METHOD FOR PRODUCING THE SAME

(71) Applicant: HAYASHIGUCHI MFG CO., LTD., Tsu-shi, Mie (JP)

(72) Inventors: Kazuhiro Nakae, Tokyo (JP); Norio Hayashiguchi, Tsu (JP)

(73) Assignee: HAYASHIGUCHI MFG CO., LTD., Tsu-shi, Mie (JP)

( * ) Notice: Subject to any disclaimer, the term of this patent is extended or adjusted under 35 U.S.C. 154(b) by 0 days.

(21) Appl. No.: 15/303,396

(22) PCT Filed: Apr. 3, 2015

(86) PCT No.: PCT/JP2015/060591

§ 371 (c)(1),
(2) Date: Oct. 11, 2016

(87) PCT Pub. No.: WO2015/156222

PCT Pub. Date: Oct. 15, 2015

(65) Prior Publication Data

US 2017/0037682 A1 Feb. 9, 2017

(30) Foreign Application Priority Data

Apr. 11, 2014 (JP) ..... 2014-081736

(51) Int. Cl.
*E06B 9/58* (2006.01)
*E06B 9/40* (2006.01)
(Continued)

(52) U.S. Cl.
CPC ..... *E06B 9/581* (2013.01); *E06B 9/40* (2013.01); *E06B 9/42* (2013.01); *E06B 9/54* (2013.01)

(58) Field of Classification Search
CPC ..... E06B 9/58; E06B 9/581; E06B 2009/585; E06B 2009/587; E06B 2009/588
(Continued)

(56) References Cited

U.S. PATENT DOCUMENTS 2,255,581 A * 9/1941 Ewing ..... A47G 5/00 160/392
2,287,667 A * 6/1942 Brown ..... E04F 10/02 16/87.4 R
(Continued)

FOREIGN PATENT DOCUMENTS

EP 2335956 A1 6/2011
EP 2857631 A1 * 4/2015 ..... E06B 9/581
(Continued)

OTHER PUBLICATIONS

Jincheleau, English Translation of "EP 2335956." Obtained from <https://worldwide.espacenet.com/>. (Year: 2011).*
(Continued)

*Primary Examiner* — Katherine W Mitchell
*Assistant Examiner* — Johnnie A. Shablack
(74) *Attorney, Agent, or Firm* — Muncy, Geissler, Olds & Lowe, P.C.

(57) ABSTRACT

Included are: a screen member 33: a fitter member 35 attached to a side end 33*a* of the screen member 33; a rail member 91 having a first chamber 91*a* and a first slit 91*b* joining the first chamber 91*a*, the first chamber 91*a* accommodating the side end 33*a* of the screen member 33 and the fitter member 35 passing through the first slit 91*b* to thereby allow the rail member 91 to hold the screen member 33 movably in a longitudinal direction of the first slit 91*b*; and a retainer 93 for retaining the rail member 91. The rail member 91 is compressively deformed in the width direction of the first slit 91*b* by the retainer 93, and the width of the
(Continued)

first slit of the compressively deformed rail member 91 is narrower than the thickness T1 of the fitter member 35.

1 Claim, 6 Drawing Sheets

(51) Int. Cl.
*E06B 9/42* (2006.01)
*E06B 9/54* (2006.01)

(58) Field of Classification Search
USPC ..... 160/270–273.1, 391, 392
See application file for complete search history.

(56) References Cited

U.S. PATENT DOCUMENTS 3,186,712 A * 6/1965 Kessler ..... A63D 1/08 160/392
4,234,035 A * 11/1980 Babbs ..... A47C 31/023 160/392
4,884,617 A * 12/1989 Coenraets ..... E06B 9/581 160/190
5,526,865 A * 6/1996 Coenraets ..... E06B 9/58 160/272
6,802,357 B2 * 10/2004 Taylor ..... B60R 21/026 160/371
7,036,549 B2 * 5/2006 Coenraets ..... E06B 9/13 160/271
7,100,667 B2 * 9/2006 Tomita ..... E06L 39/54 160/23.1
7,131,481 B2 * 11/2006 Varley ..... E06B 9/13 160/133
7,293,378 B2 * 11/2007 Bihr ..... B44D 3/185 160/395
7,389,807 B2 * 6/2008 Nagare ..... E06B 9/13 160/268.1
7,793,702 B2 * 9/2010 Biewer ..... B60J 7/0007 160/272
8,602,081 B2 * 12/2013 Komatsu ..... E06B 9/13 160/273.1
8,607,841 B2 * 12/2013 Hayashiguchi ..... E06B 9/581 160/273.1
8,662,138 B2 * 3/2014 Komatsu ..... E06B 9/13 160/194
8,851,149 B2 * 10/2014 Komatsu ..... E06B 9/13 160/266
9,127,501 B1 * 9/2015 Stobich ..... E06B 9/40
9,347,258 B2 * 5/2016 Dwarka ..... E06B 9/24
9,371,689 B2 * 6/2016 Licciardi Di Stefano ..... E06B 9/581
9,512,612 B2 * 12/2016 Gower ..... E04B 1/40
9,617,786 B2 * 4/2017 Roberts ..... E06B 9/42
9,994,093 B2 * 6/2018 Rikkert ..... B60J 1/2052
2005/0211397 A1 * 9/2005 Coenraets ..... E06B 9/582 160/271
2009/0229767 A1 * 9/2009 Mullet ..... E06B 9/581 160/26
2011/0100570 A1 * 5/2011 Licciardi Di Stefano ..... E06B 9/581 160/368.1
2011/0108214 A1 * 5/2011 Komatsu ..... E06B 9/13 160/272
2012/0255683 A1 * 10/2012 Komatsu ..... E06B 9/13 160/84.04
2012/0325416 A1 * 12/2012 Hayashiguchi ..... E06B 9/581 160/272
2013/0068400 A1 * 3/2013 Dwarka ..... E06B 9/58 160/120
2014/0158313 A1 * 6/2014 McTavish ..... E06B 9/58 160/270
2014/0262084 A1 * 9/2014 Fleischman ..... E06B 9/58 160/368.1
2016/0032646 A1 * 2/2016 Fleischman ..... E06B 9/40 160/309
2016/0348424 A1 * 12/2016 Lorenzani ..... E06B 9/13
2017/0081910 A1 * 3/2017 Gower ..... E04B 1/40
2017/0159358 A1 * 6/2017 Alonso Fabregat .... E06B 9/581

FOREIGN PATENT DOCUMENTS

JP S58-168698 U 11/1983
JP H01-142794 U 9/1989
JP H06-029440 Y2 8/1994
JP 11-141250 A 5/1999
JP 2004-211298 * 7/2004 ..... E06B 9/17
WO WO-2012050518 A1 * 4/2012 ..... E06B 9/40
WO 2012/176332 A1 12/2012

OTHER PUBLICATIONS

Office Action of Japanese corresponding application No. 2014-081736 dated May 23, 2017 and English translation thereof.

* cited by examiner

SCREEN APPARATUS AND METHOD FOR PRODUCING THE SAME

TECHNICAL FIELD

The present invention relates to a screen apparatus and a method for producing the same.

BACKGROUND ART

Conventionally, a roll-up type screen apparatus described in Patent Literature 1 is, for example, known as a screen apparatus. The roll-up type screen apparatus includes a net as a screen, a roll-up shaft on which the net is wound, fitter members (engaging members) attached to side ends of the screen, and hollow guiders. Each of the fitter members attached to the side ends of the screen is placed in the corresponding guider by passing through a slit formed therein, and is movable in a rolling-up direction of the roll-up shaft. In the roll-up type screen apparatus, the thickness of the fitter member positioned in the guider is set to be larger than the width of the slit, thereby causing the net and the guider to engage with each other. Furthermore, the fitter member positioned in the guider is rolled up together with the net on the roll-up shaft.

Meanwhile, in the aforementioned roll-up type screen apparatus, for example, it is necessary to set the thickness of the fitter member to be small in order to make the wound-diameter of the net and the fitter member on the roll-up shaft smaller. However, there is a possibility that the fitter member passes through the slit and comes off the guider when the thickness of the fitter member is small In order to solve this problem, it is necessary to set the width of the slit to be extremely narrow in accordance with the thickness of the fitter member. However, in the production process of such a roll-up type screen apparatus, it is difficult to form an extremely narrow slit in a guider.

CITATION LIST

Patent Literature

Patent Literature 1: Japanese Examined Utility Model Publication No. HEI 6-29440

SUMMARY OF INVENTION

The present invention has an object of providing a screen apparatus and a method for producing the same, which have solved the aforementioned problems.

A screen apparatus according to one aspect of the present invention includes: a screen member; a fitter member attached to a side end of the screen member; a rail member including a chamber and a slit joining the chamber, the chamber accommodating the fitter member and the side end of the screen member passing through the slit to thereby allow the rail member to hold the screen member movably in a longitudinal direction of the slit; a retainer member for retaining the rail member, wherein the rail member is compressively deformed in a width direction of the slit by the retainer member, and the width of the slit of the compressively deformed rail member is narrower than a thickness of the fitter member.

A method for producing a screen apparatus according to another one aspect of the present invention includes steps of: extrusion molding a rail member including a first chamber and a first slit joining the first chamber; allowing the rail member to hold the screen member movably in a longitudinal direction of the first slit by attaching a fitter member to a side end of a screen member, and accommodating the fitter member and the side end of the screen member passing through the first slit in the first chamber; preparing a retainer member including a second chamber and a second slit joining the second chamber; and accommodating the rail member in the second chamber while allowing the first slit to face the second slit, wherein, in the step of molding the rail member, the width of the wall of the rail member that is formed with the first slit is set to be larger than the width of the second chamber, and a width of the wall of the rail member that is opposite to the wall formed with the first slit is set to be equal to or smaller than the width of the second chamber, and in the step of accommodating the rail member, the wall of the rail member that is formed with the first slit is compressively deformed in a width direction of the first slit in the second chamber to decrease the width of the first slit and thereby render the width of the first slit narrower than a thickness of the fitter member.

DESCRIPTION OF EMBODIMENTS

Hereinafter, an embodiment of the present invention will be described with reference to the accompanying drawings. However, it should be noted that, in consideration of explanation, the respective drawings to be referred to hereafter are simply illustrated by primary components required to describe the present invention among constituent components of the embodiment of the present invention. Therefore, a screen apparatus according to the present invention may be provided with desired constituent components unillustrated in the respective drawings referred to in the present specification.

Figure 1:
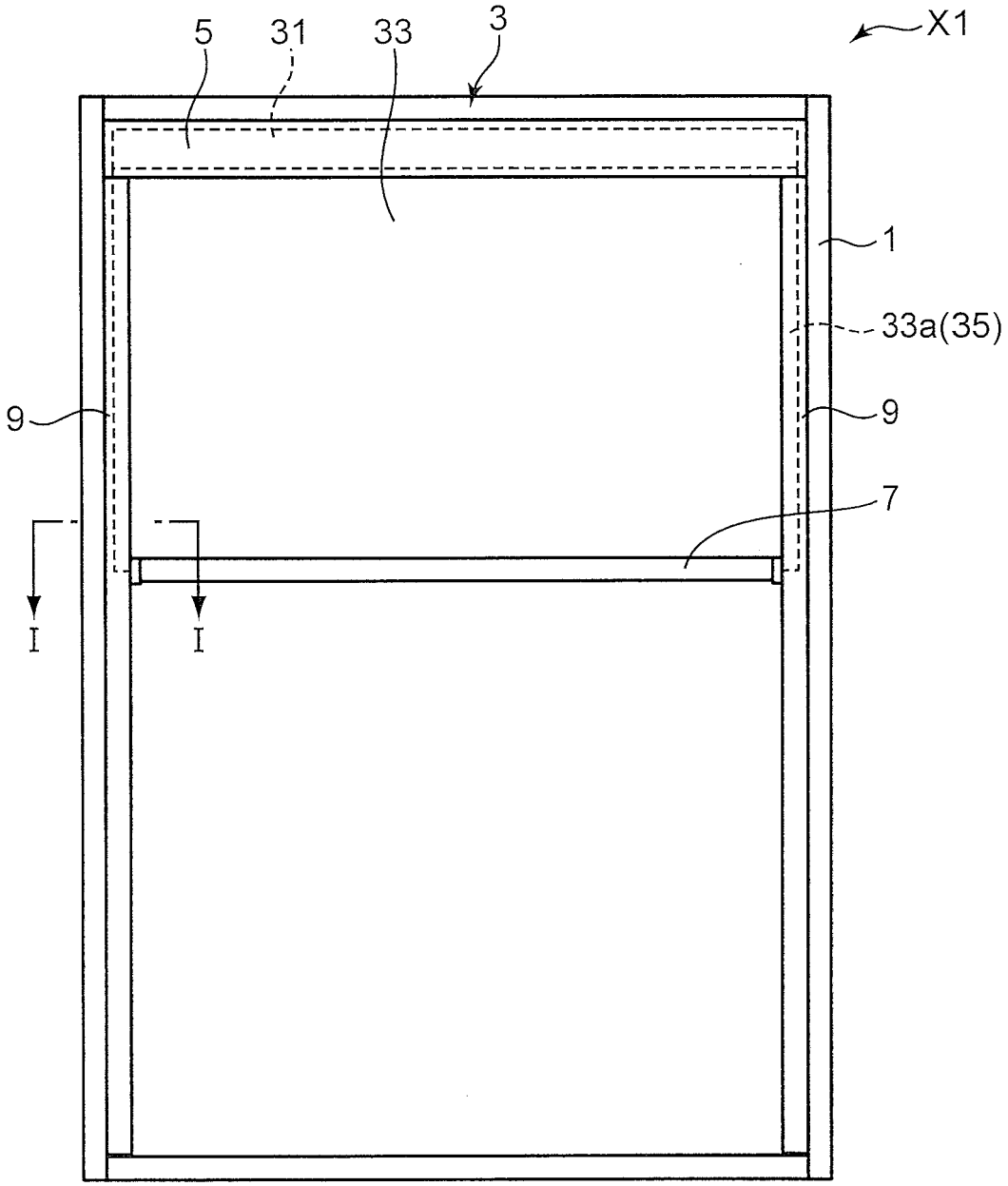
FIG. 1 is a schematic plan view illustrating a screen apparatus according to an embodiment of the present invention.
Figure 2:
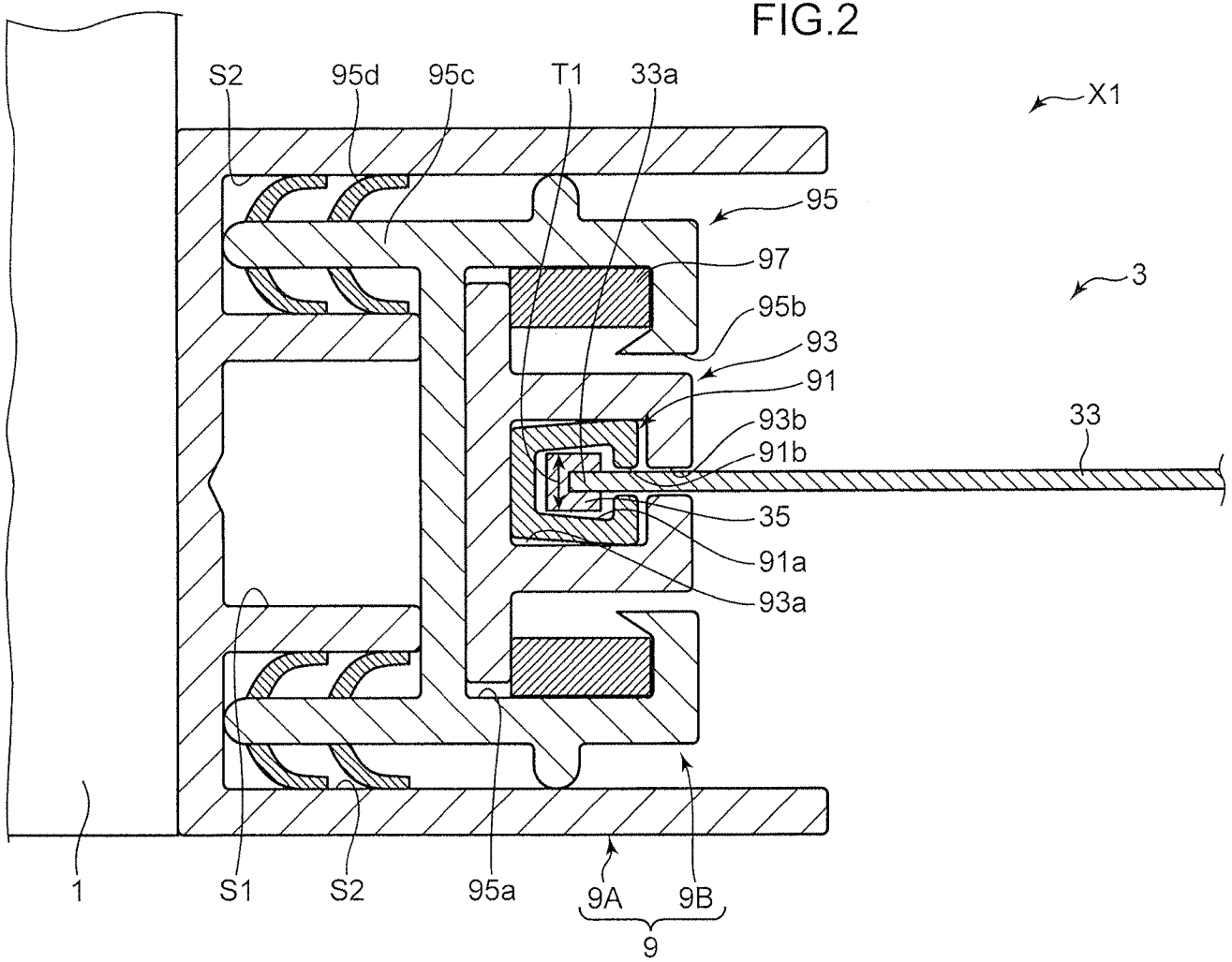
FIG. 2 is a cross sectional view taken along the line I-I in FIG. 1

As illustrated in FIGS. 1 and 2, a screen apparatus X1 is a roll-up type screen apparatus adoptable to a window frame of a house or the like. The screen apparatus X1 includes a frame unit 1, a roll screen 3, a front cover 5, a weight bar 7, and guiders 9. For example, the screen apparatus X1 may have a structure wherein a screen member 33 to be described later is rolled up by an electric motor, or another structure wherein the screen member 33 is manually rolled up by a chain or the like. Also, the present invention may be applicable to a screen apparatus of other type in addition to the roll-up type. The present invention may be also applicable to, for example, a projector screen or the like, in addition to a window frame of a house.

The frame unit 1 constitutes an outer frame of the screen apparatus X1. In the present embodiment, the frame unit 1 has a rectangular shape in a plan view. Also, a rectangular region surrounded by the frame unit 1 is covered with the screen member 33 to be described later. Furthermore, the shape of the frame unit 1 is not limited to a rectangle in the plan view, but may be suitably changed in accordance with a use of the screen apparatus X1. Furthermore, the screen apparatus may be made without a frame unit 1. For example, a window frame of a house or the like may be utilized as a frame unit 1.

The roll screen 3 includes a roll-up shaft 31, the screen member 33, and fitter members 35.

The roll-up shaft 31 serves to roll up the screen member 33. The roll-up shaft 31 is a cylindrical member extending in a short direction of the frame unit 1. The roll-up shaft 31 is arranged along an upper member of the frame unit 1 in the region surrounded by the frame unit 1. Additionally, the roll-up shaft 31 is attached to the opposite side members of the frame unit 1, and is rotatable in a circumferential direction of the roll-up shaft 31. However, the roll-up shaft 31 may be arranged along a lower member of the frame unit 1.

The screen member 33 serves to cover the region surrounded by the frame unit 1. An upper end of the screen member 33 is connected to the roll-up shaft 31. Moreover, the screen member 33 is rolled up on the roll-up shaft 31 in accordance with the rotation of the roll-up shaft 31 to thereby expose a part of or entirety of the region surrounded by the frame unit 1. Furthermore, the screen member 33 is loosed out from the roll-up shaft 31 in accordance with the rotation of the roll-up shaft 31 to thereby cover a part of or entirety of the region surrounded by the frame unit 1.

The fitter members 35 serve to keep the screen member 33 to be described later from coming off the guiders 9. Also, the fitter members 35 guide the screen member 33 to be vertically movable along the guiders 9. The fitter members 35 are respectively attached to opposite ends 33*a* of the screen member 33. The fitter members 35 enclose the opposite ends 33*a* of the screen member 33 from the front and back sides of the screen member 33, and extend in the longitudinal direction of the frame unit 1. Furthermore, the fitter members 35 attached to the opposite ends 33*a* of the screen member 33 are respectively accommodated in the guiders 9 attached to the opposite side members of the frame unit 1. In this manner, the screen member 33 is supported by the guiders 9 in the short direction of the frame unit 1 and vertically movable in the longitudinal direction of the frame unit 1 along the guiders 9. Additionally, when the screen member 33 is rolled up in accordance with the rotation of the roll-up shaft 31, the fitter members 35 are rolled up together with the screen member 33 on the roll-up shaft 31.

The front cover 5 serves to prevent the roll-up shaft 31 from being seen by a user. The front cover 5 is arranged in front of the roll-up shaft 31, i.e. on the user side, so as to overlap the roll-up shaft 31 in a plan view. For example, the front cover 5 is fixedly attached to the frame unit 1 by use of an unillustrated magnet sheet or the like.

The weight bar 7 serves to apply an appropriate tension to the screen member 33 in the longitudinal direction of the frame unit 1 in a state where the screen member 33 has been loosed out from the roll-up shaft 31. The weight bar 7 extends in the short direction of the frame unit 1, and is attached to a lower end of the screen member 33.

The guiders 9 serve to guide the vertical movement of the screen member 33. Each of the guiders 9 includes an outer guider 9A and an inner guider 9B.

The outer guider 9A is a member for accommodating the inner guider 9B, and serves to prevent the inner guider 9B from being seen by the user. The outer guider 9A is arranged along each of the opposite side members of the frame unit 1 in the region surrounded by the frame unit 1. The outer guider 9A is a C-like shaped member extending in the longitudinal direction of the frame unit 1. The bottom of the outer guider 9A is connected to the side member of the frame unit 1 by an unillustrated screw. In the present embodiment, as illustrated in FIG. 2, a recess of the outer guider 9A has a first cavity S1 for accommodating a head of the screw, and two second cavities S2 in which mounting parts 95*c* of a mounting member 95 to be described later are held, the two second cavities S2 facing each other across the first cavity S1. The cavity S1 and the respective second cavities S2 are divided from one another by partition walls extending in the short direction of the frame unit 1 from the bottom of the outer guider 9A.

The inner guider 9B is a member to be accommodated in the recess of the outer guider 9A. The inner guider 9B serves to accommodate one of the side ends 33*a* of the screen member 33 and one of the fitter members 35 in such a manner as to allow the vertical movement of the screen member 33. Like the outer guider 9A, the inner guider 9B is arranged along each of the opposite side members of the frame unit 1 in the region surrounded by the frame unit 1. Moreover, the inner guider 9B has a rail member 91, a retainer member 93, the mounting member 95, and an elastic member 97.

The rail member 91 serves to directly guide the vertical movement of the screen member 33, while accommodating the side end 33*a* of the screen member 33 and the fitter member 35. The rail member 91 has a hollow shape, and includes a first chamber 91*a* being identical to the hollow portion, and a first slit 91*b* connecting the first chamber 91*a* to the outside of the rail member 91 and extending in a longitudinal direction of the rail member 91. The side end 33*a* of the screen member 33 and the fitter member 35 are accommodated in the first chamber 91*a* by passing through the first slit 91*b*. In other words, the screen member 33 is inserted into the first chamber 91*a* by passing through the first slit 91*b*. In this manner, the screen member 33 extends from the first chamber 91*a* to the outside of the rail member 91. Furthermore, the fitter member 35 is attached to the side end 33*a* of the screen member 33 positioned in the first chamber 91*a*.

Here, the width of the first slit 91*b* is narrower than the thickness T1 of the fitter member 35. Hence, it is possible to keep the side end 33*a* of the screen member 33 to which the fitter member 35 is attached from passing through the first slit 91*b* and coming off the rail member 91. Furthermore, the width of the first chamber 91*a* is larger than the thickness T1 of the fitter member 35. Therefore, the fitter member 35 is movable in the first chamber 91*a* in the longitudinal direction of the frame unit 1 in a state where the screen member 33 is supported in the short direction of the frame unit 1.

The retainer member 93 serves to retain the rail member 91. The retainer member 93 has a hollow shape, and includes a second chamber 93*a* being identical to the hollow portion, and a second slit 93*b* connecting the second chamber 93*a* to the outside of the retainer member 93. The second chamber 93*a* accommodates the rail member 91. In this way, the retainer member 93 retains the rail member 91. Furthermore, the second slit 93*b* extends in a longitudinal direction of the retainer member 93, and faces the first slit 91*b*. The width of the second slit 93*b* is set to be larger than the width of the first slit 91*b*.

The mounting member 95 serves to fixedly mount the inner guider 9B to the outer guider 9A when accommodating the inner guider 9B in the recess of the outer guider 9A. The mounting member 95 has a hollow shape, and includes a third chamber 95*a*, a third slit 95*b*, the mounting parts 95*c*, and a plurality of protrusions 95*d*. The third chamber 95*a* is identical to the hollow portion of the mounting member 95. The third slit 95*b* connects the third chamber 95*a* to the outside of the mounting member 95. The third slit 95*b* extends in a longitudinal direction of the mounting member 95. The mounting parts 95*c* are respectively put into the second cavities S2. The protrusions 95*d* protrude from the surfaces of the mounting parts 95*c*.

The third chamber 95*a* accommodates the retainer member 93. Furthermore, the wall of the retainer member 93 accommodated in the third chamber 95*a* that is formed with the second slit 93*b* is exposed from the third slit 95*b* of the mounting member 95. Moreover, the elastic member 97 is placed between an inner surface of the mounting member 95 and an outer surface of the retainer member 93. In this configuration, the distance between the retainer members 93 arranged on the opposite side members of the frame unit 1 is adjusted. The distance is set to apply an appropriate tension to the screen member 33 in the short direction of the frame unit 1.

The mounting parts 95*c* extend to the bottom of the outer guider 9A from the wall of the mounting member 95 that is opposite to the wall formed with the third slit 95*b*. Also, the two mounting parts 95*c* are provided in correspondence to the two second cavities S2, i.e. the two mounting parts 95*c* are respectively put into the second cavities S2. Moreover, the plurality of protrusions 95*d* are softer than the mounting parts 95*c*. The plurality of protrusions 95*d* are elastically deformed by a contact with the inner surface of the outer guider 9A which surrounds the second cavities S2 when the mounting parts 95*c* are put into the second cavities S2. Furthermore, the plurality of protrusions 95*d* apply a resilient counterforce to the inner surface of the outer guider 9A. In this manner, the mounting parts 95*c* and the plurality of protrusions 95*d* are fixedly put into the second cavities S2. In other words, in the screen apparatus X1, the inner guider 9B is accommodated in the recess of the outer guider 9A by accommodating the mounting parts 95*c* of the mounting part 95 of the inner guider 9B in the second cavities S2.

Figure 3:
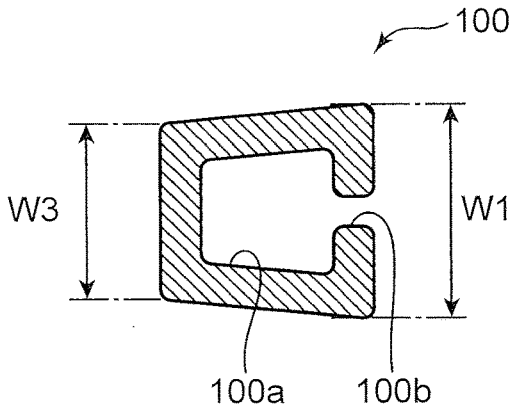
FIG. 3 is a schematic cross sectional view illustrating only a rail member for an inner guider according to the embodiment, and a state before the rail member is accommodated in a second chamber of a retainer member.
Figure 4:
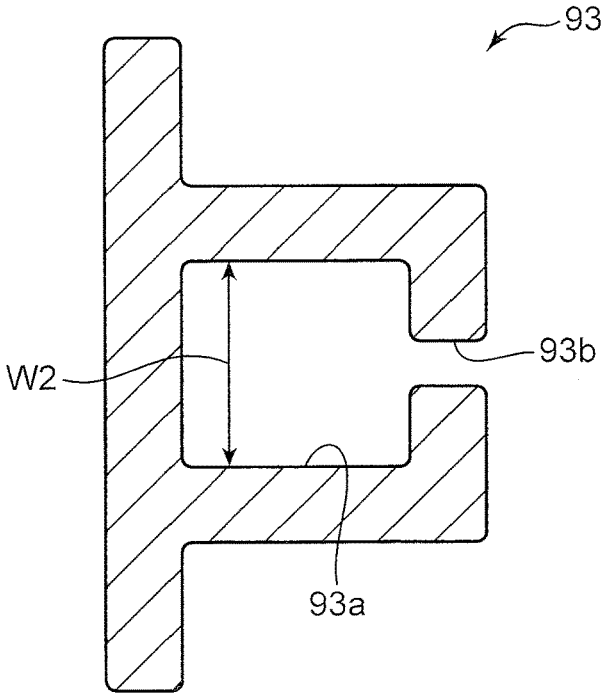
FIG. 4 is a schematic cross sectional view illustrating only the retainer member for the inner guider according to the embodiment.

Meanwhile, in the screen apparatus X1, the rail member 91 is compressively deformed in a width direction of the first slit 91*b* by the retainer member 93. In this way, the width of the first slit 91*b* is kept to be narrower than the thickness T1 of the fitter member 35. Specifically, as illustrated in FIGS. 3 and 4, the width W1 of the wall of a rail member 100 that is formed with a first slit 100*b* is set to be larger than the width W2 of the second chamber 93*a* of the retainer member 93, the rail member 100 corresponding to the rail member 91 which is yet to be retained by the retainer member 93. Hence, in a state where the rail member 100 is retained by the retainer member 93, i.e. the rail member 100 is put into the second chamber 93*a* of the retainer member 93, the wall of the rail member 100 that is formed with the first slit 100*b* is compressively deformed in the width direction of the first slit 100*b*. In this way, the width of the first slit 91*b* of the rail member 91 retained by the retainer member 93 becomes narrower than the width of the first slit 100*b* of the rail member 100 which is yet to be retained by the retainer member 93.

As described above, in the screen apparatus Xl, the first slit 91*b* of the rail member 91 is defined by the retainer member 93 which makes the width of the first slit 100*b* of the rail member 100 narrower. Therefore, for example, when the thickness T1 of the fitter member 35 is set to be smaller with the aim of decreasing a wound-diameter of the fitter member 35 on the roll-up shaft 31, it is possible to keep the fitter member 35 from coming off the first slit 91*b* even without making the first slit 100*b* formed in the rail member 100 extremely narrow in the production process of the screen apparatus X1. Additionally, as described above, it is unnecessary to make the first slit 100*b* formed in the rail member 100 extremely narrow in the production process of the screen apparatus X1. Accordingly, when the rail member 100 is, for example, formed by extrusion molding the resin material, it is possible to avoid entire closure of the first slit 100*b* due to the narrow width. As a result, the rail member 100 can be easily made.

Furthermore, in the present embodiment, the rail member 91 is accommodated in the second chamber 93*a* of the retainer member 93, and compressively deformed in a width direction of the first slit 91*b* in the second chamber 93*a*. This configuration makes it possible to keep the rail member 91 from coming off the retainer member 93 in the second chamber 93*a*, while rendering the narrow width of the first slit 91*b*. Moreover, the second chamber 93*a* and the second slit 93*b* may be omitted in the retainer member 93. The retainer member 93 may be sufficient to have at least a configuration to cause the rail member 91 to be compressively deformed in the width direction of the first slit 91*b*.

Also, in the present embodiment, the width W3 of the wall of the rail member 100 that is opposite to the wall formed with the first slit 100*b* is equal to or narrower than the width W2 of the second chamber 93*a*. This configuration makes it possible to easily accommodate the rail member 100 in the second chamber 93*a*, since the wall opposite to the wall formed with the first slit 100*b* is not compressively deformed in the width direction of the first slit 100*b*.

Additionally, in the present embodiment, the rigidity of the retainer member 93 is higher than that of the rail member 100. This configuration can ensure the compressive deformation of the rail member 100 by the retainer member 93. The rigidity of the retainer member 93 and the rail member 100 is appropriately adjusted in accordance with material, thickness, or the like of each of these members.

The above-described screen apparatus X1 can be efficiently and easily produced by, for example, a method including steps which will be described below. Hereinafter, a method for producing a screen apparatus X1 will be described with reference to FIGS. 5 to 7.

1) Step of Attaching a Roll Screen 3 and an Outer Guider 9A

Figure 5:
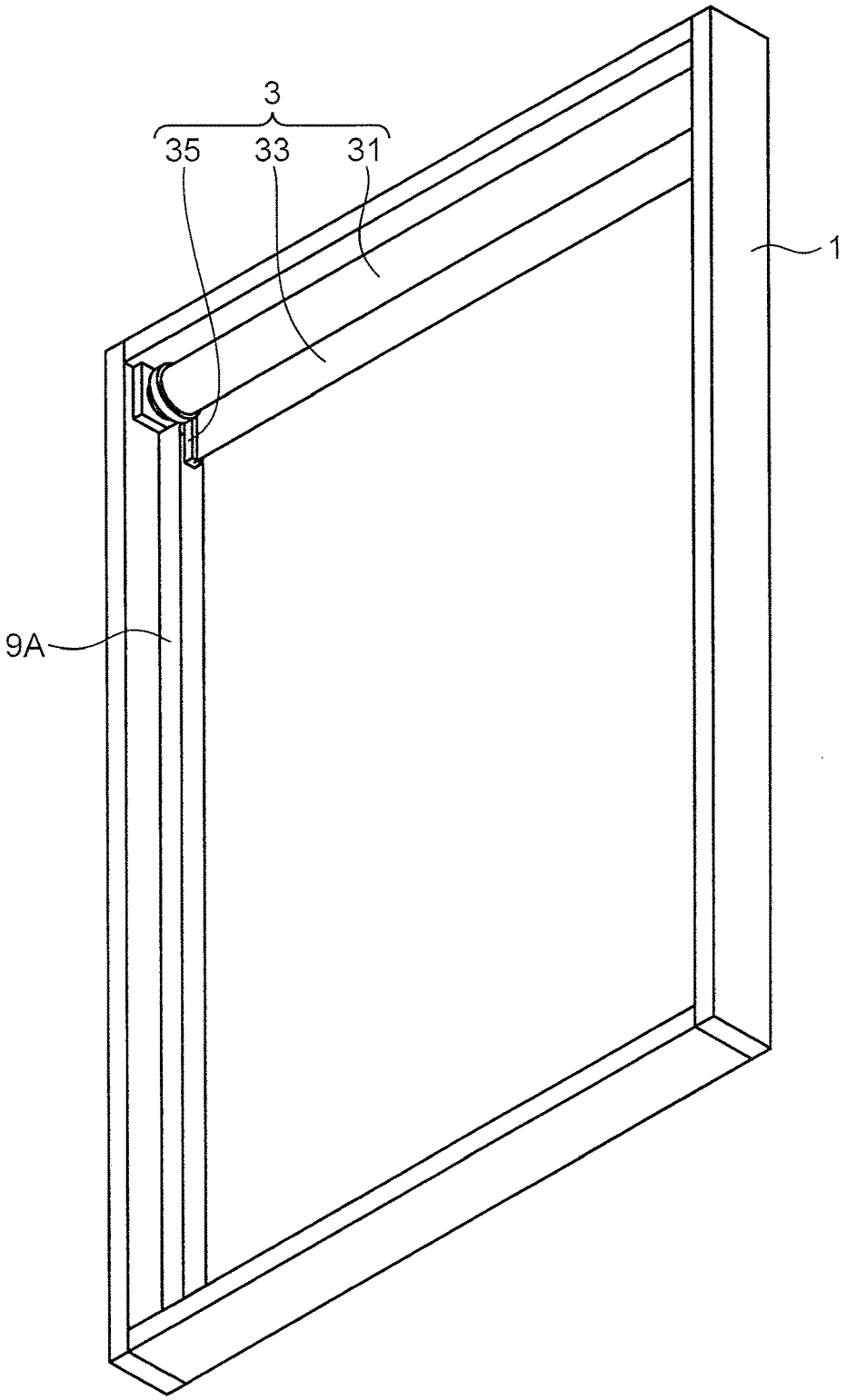
FIG. 5 is a diagram illustrating a state where a roll screen and an outer guider are attached to a frame unit, and showing a step of the production process of the screen apparatus according to the embodiment.

A step of attaching a roll screen 3 and an outer guider 9A will be described with reference to FIG. 5.

In this step, at first, a frame unit 1 made of metal material, resin material or the like is prepared. The frame unit 1 has a substantially rectangular shape in a plan view.

Next, a roll screen 3 including a roll-up shaft 31, a screen member 33, and fitter members 35 is prepared, and the prepared roll screen 3 is attached to the frame unit 1. Specifically, the screen member 33 made of fabric or the like is folioed into a substantially rectangular shape to have an area equivalent to a region surrounded by the frame unit 1.

Then, the fitter members 35 made of resin material or the like are attached to the opposite ends 33*a* of the screen member 33, i.e. along the opposite longitudinal-side ends of the screen member 33. Further specifically, the fitter members 35 each having a tape-like shape are bended, and adhered to the opposite ends 33*a* of the screen member 33 in such a manner as to enclose the opposite ends 33*a* of the screen member 33 from the front and back sides of the screen member 33. After that, an upper end of the screen member 33, i.e. one short-side end of the screen member 33, is connected to the roll-up shaft 31 having a cylindrical shape in an axial direction of the roll-up shaft 31. In this manner, the screen member 33 and the fitter members 35 are rolled up on the roll-up shaft 31 in the circumferential direction of the roll-up shaft 31. The roll screen 3 prepared in this manner is arranged in the region surrounded by the frame unit 1 along an upper member of the frame unit 1. Further, the roll-up shaft 31 of the roll screen 3 is fixedly attached to the opposite side members of the first unit 1, and is rotatable in the circumferential direction of the roll-up shaft 31.

Subsequently, an outer guider 9A made of metal material, resin material, or the like is prepared, and the prepared outer guider 9A is attached to the frame unit 1. Specifically, the outer guider 9A is a C-like shaped member extending in one direction. The outer guider 9A is formed with two partition walls extending in a direction perpendicularly intersecting the one direction in a recess of the outer guider 9A from the bottom of the outer guider 9A. In this configuration, the recess of the outer guider 9A includes a first cavity S1 and two second cavities S2 divided by the two partition walls. The outer guider 9A is arranged in the region surrounded by the frame unit 1 along each of the opposite side members of the frame unit 1. Moreover, the bottom of the outer guider 9A is fixedly attached to the side member of the frame unit 1 via a screw or the like, and the head of the screw is arranged in the first cavity S1.

2) Step of Accommodating an Inner Guider 9B

Figure 6:
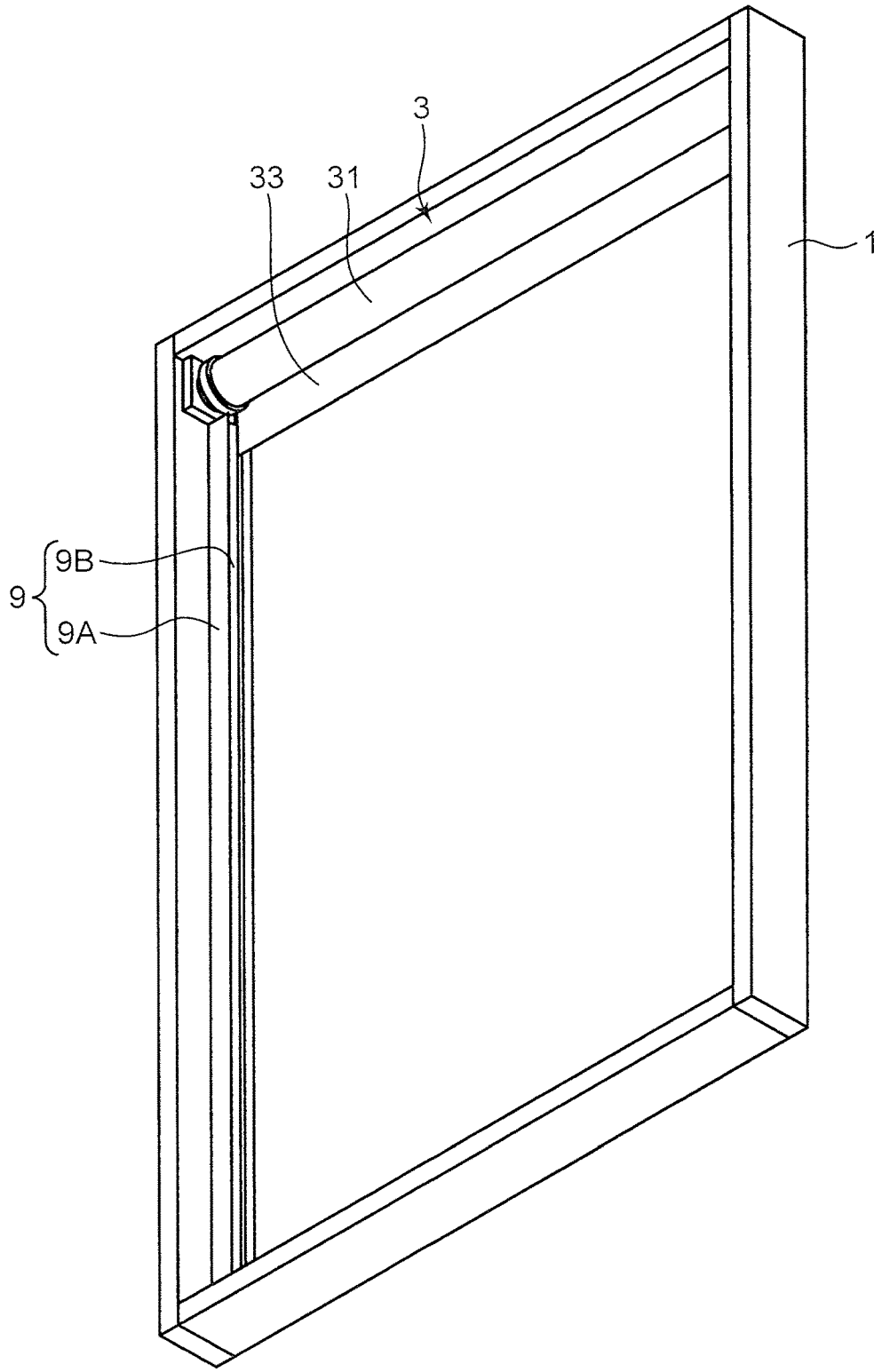
FIG. 6 is a diagram illustrating a state where the inner guider is mounted in the outer guider, and showing another step of the production process of the screen apparatus according to the embodiment.

Next, a step of accommodating an inner guider 9B will be described with reference to FIG. 6.

In this step, at first, an inner guider 9B including a rail member 91, a retainer member 93, a mounting member 95, and an elastic member 97 is prepared.

Specifically, a rail member 100 illustrated in FIG. 3 is prepared, and a retainer member 93 illustrated in FIG. 4 is prepared. The rail member 100 becomes the rail member 91 by being retained by the retainer member 93. The rail member 100 is formed by extrusion molding a resin material to have a hollow shape extending in one direction. The rail member 100 is formed with a first chamber 100*a* which is identical to the hollow portion of the rail member 100 and a first slit 100*b* joining the first chamber 100*a* and extending in the one direction. Moreover, the retainer member 93 is formed by extrusion molding a resin material to have a hollow shape extending in one direction. The retainer member 93 is formed with a second chamber 93*a* which is identical to the hollow portion of the retainer member 93, and a second slit 93*b* joining the second chamber 93*a* and extending in the one direction. Here, the width W2 of the second chamber 93*a* is set to be smaller than the width W1 of the wall of the rail member 100 that is formed with the first slit 100*b*, and equal to or larger than the width W3 of the wall of the rail member 100 that is opposite to the wall formed with the first slit 100*b*. Further, the rail member 100 is inserted into the second chamber 93*a* of the retainer member 93 in the longitudinal direction of the retainer member 93. The width of the first slit 100*b* is decreased by accommodating the inserted rail member 100 in the second chamber 93*a* and compressively deforming the wall formed with the first slit 100*b*. As a result, the rail member 100 becomes the rail member 91. In this case, the width of a first slit 91*b* of the rail member 91 is set to be narrower than the thickness T1 of the fitter member 35.

Subsequently, a mounting member 95 is prepared. The mounting member 95 is formed by extrusion molding a resin material to have a hollow shape extending in one direction. The mounting member 95 is formed with a third chamber 95*a* which is identical to the hollow portion of the mounting member 95, and a third slit 95*b* joining the third chamber 95 and extending in the one direction. Furthermore, the mounting member 95 is formed with mounting parts 95*c* positioned at the opposite ends in the width direction of the wall of the mounting member 95 that is opposite to the wall formed with the third slit 95*b*, the mounting parts 95*c* extending in a direction away from the third chamber 95*a*. Moreover, the mounting member 95 has a plurality of protrusions 95*d* protruding from each of the mounting parts 95*c*. The plurality of protrusions 95*d* are formed to be softer than other portions of the mounting member 95. Hence, the so-called two-color molding for integrally molding different materials is applied to the extrusion molding of the mounting member 95. After that, the rail member 91 and the retainer member 93 are inserted into the third chamber 95*a* of the mounting member 95 in the longitudinal direction of the mounting member 95. In this case, the elastic member 97 is placed between an outer surface of the retainer member 93 and an inner surface of the mounting member 95. The relative position of the retainer member 93 to the mounting member 95 is set by the elastic member 97.

The inner guider 9B prepared in this manner is arranged in the longitudinal direction of the outer guider 9A, and accommodated in the recess of the guider 9A. Specifically, the mounting parts 95*c* of the mounting member 95 in the inner guider 9B are inserted into the second cavities S2 in the recess of the outer guider 9A. In this case, the plurality of protrusions 95*d* protruding from the mounting parts 95*c* are elastically deformed by a contact with the inner surface of the outer guider 9A, and a resilient counterforce is applied to the inner surface. In this way, the mounting parts 95*c* and the plurality of protrusions 95*d* are fixedly put into the second cavities S2, and the inner guider 9B is accommodated in the recess of the outer guider 9A.

Also, the side end 33*a* of the screen member 33 and the fitter member 35 attached to the side end 33*a* of the screen member 33 are inserted into the first chamber 91*a* of the rail member 91 in the longitudinal direction of the rail member 91. In this case, a portion of the screen member 33 leading to the side end 33*a* in the short direction of the screen member 33 inserts into the first slit 91*b* and the second slit 93*b*.

3) Step of attaching a front cover 5 and a weight bar 7.

Figure 7:
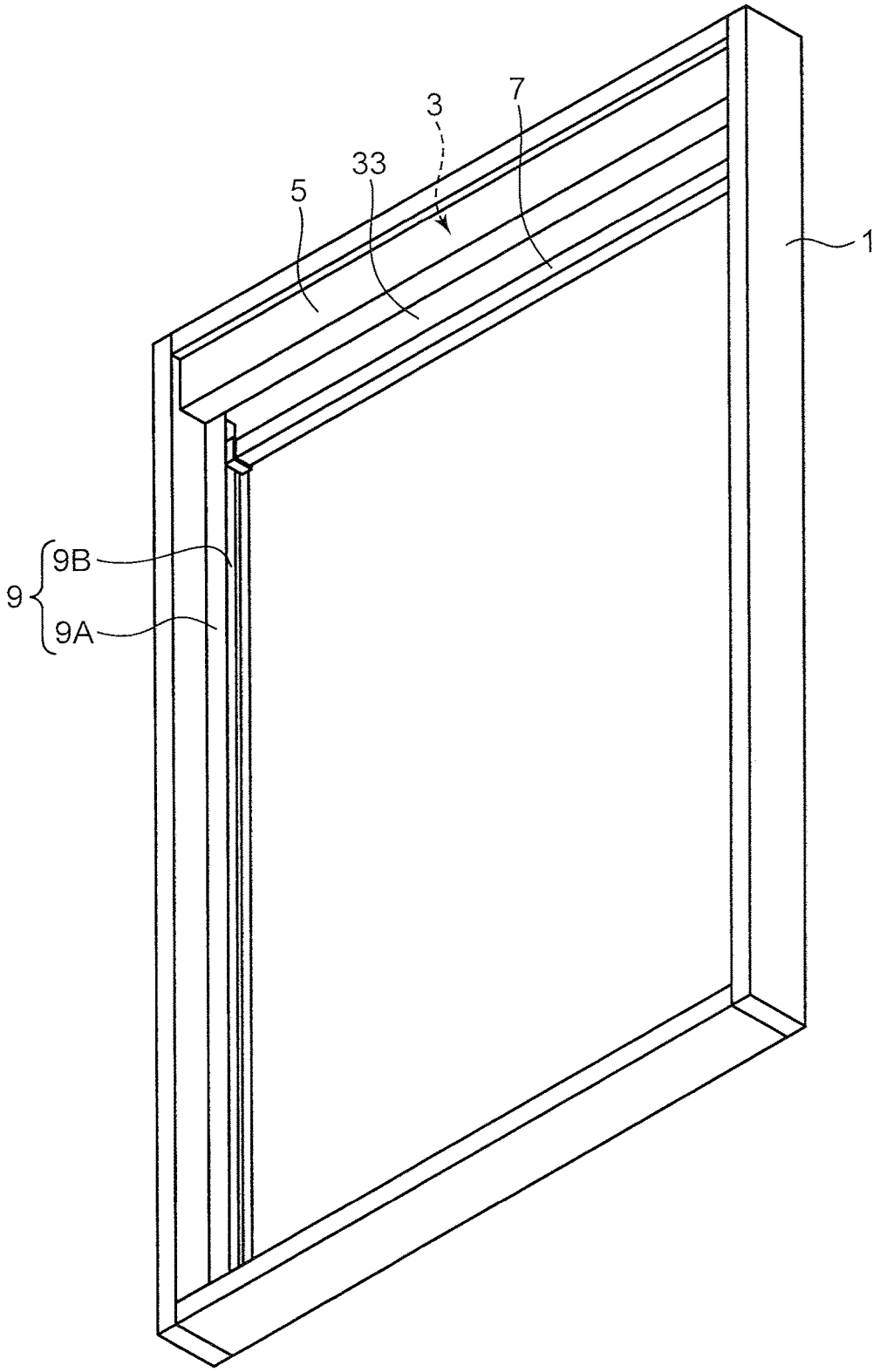
FIG. 7 is a diagram illustrating a state where a front cover and a weight bar are attached, and showing further another step of the production process of the screen apparatus according to the embodiment.

Next, a step of attaching a front cover 5 and a weight bar 7 will be described with reference to FIG. 7.

In this step, at first, a front cover 5 made of metal material or the like is prepared, and the prepared front cover 5 is attached to the frame unit 1. Specifically, the front cover 5 is large enough to prevent the roll screen 3 from being seen by a user in a state where the screen member 33 and the fitter members 35 are fully rolled up on the roll-up shaft 31. The front cover 5 is arranged in front of the roll-up shaft 31, and fixedly attached to the frame unit 1 via an unillustrated magnet sheet or the like.

Furthermore, a weight bar 7 is prepared, and the prepared weight bar 7 is attached to the screen member 33. Specifically, the weight bar 7 is a member extending in one direction, and heavy enough to provide an appropriate tension to the screen member 33. As illustrated in FIG. 7, the weight bar 7 is arranged along a lower end of the screen member 33, i.e. along the short-side end of the screen member 33 that is opposite to the short-side end connected to the roll-up shaft 31, so as to be connected to the lower end. The opposite ends of the weight bar 7 are arranged in the recesses of the outer guiders 9A. In this manner, vertical movement of the weight bar 7 is guided by the outer guider 9A. Also, the weight bar 7 may be attached to the lower end of the screen member 33 when the roll screen 3 is attached to the frame unit 1 during the step of attaching the roll screen 3 and the outer guider 9A.

According to the above-described method for producing the screen apparatus X1, the production process is simplified by molding the rail member 100 into a specific shape. Specifically, in the method for producing the screen apparatus X1, the width W1 of the wall of the rail member 100 that is formed with the first slit 100*b* is larger than the width W2 of the second chamber 93*a*, and the wall of the rail member 100 that is opposite to the wall formed with the first slit 100*b* is equal to or smaller than the width W2 of the second chamber 93*a*. Hence, the wall of the rail member 100 that is formed with the first slit 100*b* is pressed to the inner surface of the retainer member 93 when the rail member 100 is accommodated in the second chamber 93*a*, and thus compressed in the width direction of the first slit 100*b*. Therefore, the method for producing the screen apparatus X1 can realize the accommodating of the rail member 100 in the second chamber 93*a* and the decreasing in the width of the first slit 100*b* at the same time. Additionally, the wall of the rail member 100 that is opposite to the wall formed with the first slit 100*b* does not apply the resilient counterforce to the inner surface of the retainer member 93 in the width direction of the second chamber 93*a*. Hence, it is possible to easily accommodate the rail member 100 in the second chamber 93*a*. Consequently, the production process of the screen apparatus X1 will be simplified.

Moreover, the method for producing a screen apparatus X1 makes it possible to achieve easy molding of a rail member 100. Specifically, in the case of extrusion molding a resin material to form a rail member 100 which includes a first slit 100*b* having an extremely narrow width like the method for producing a screen apparatus X1, there is a possibility that the first slit 100*b* is entirely closed in the extrusion molding, which makes it difficult to form the first slit 100*b* in the rail member 100. However, the aforementioned method for producing the screen apparatus X1 can decrease the width of the first slit 100*b* by accommodating the rail member 100 in the second chamber 93*a*. Additionally, it is unnecessary to make the first slit 100*b* formed in the rail member 100 extremely narrow. As a result, the rail member 100 can be easily molded.

The above-described embodiments merely show examples in all the aspects, and thus should not be considered to be limited. The scope of the invention should be defined by the scope of claims, not the description of the above-described embodiments, and further cover meanings equivalent to those readable in the scope of claims and all the changes falling within the scope of the claims.

Hereinafter, the embodiments will be briefly described.

A screen apparatus according to the present embodiment includes: a screen member; a fitter member attached to a side end of the screen member; a rail member including a chamber and a slit joining the chamber, the chamber accommodating the fitter member and the side end of the screen member passing through the slit to thereby allow the rail member to hold the screen member movably in a longitudinal direction of the slit; a retainer member for retaining the rail member, wherein the rail member is compressively deformed in a width direction of the slit by the retainer member, and a width of the slit of the compressively deformed rail member is narrower than a thickness of the fitter member.

In the above-described screen apparatus, the retainer member compressively deforms the rail member to thereby make it possible to decrease the width of the slit. This configuration can keep the engaging member from passing through the slit and coming off the chamber. Specifically, in the screen apparatus, the rail member which includes the slit is retained by the retainer member, and thus is compressively deformed in the width direction of the slit. Because of the compressive deformation, the width of the slit in the rail member retained by the retainer member becomes smaller than the width of the slit of the rail member which is yet to be retained by the retainer member. In other words, in the screen apparatus, the width of the slit is decreased by the retainer member after the slit is formed in the rail member in the production process of the screen apparatus. Furthermore, the width of the slit in the rail member retained by the retainer member is set to be narrower than the thickness of the fitter member. As described above, in the screen apparatus, the width of the slit can be decreased owing to the retainer member without making the slit having an extremely narrow width in the rail member. Accordingly, it is possible to easily mold the rail member, and keep the fitter member from passing through the slit and coming off the chamber.

It is preferable that the chamber of the rail member is defined as a first chamber and the slit of the rail member is defined as a first slit, and the retainer member includes a second chamber for accommodating the rail member while compressively deforming the rail member in a short direction of the first slit, and a second slit joining the second chamber and the first slit and setting along a longitudinal direction of the first slit.

The screen apparatus having the aforementioned structure makes it possible to decrease the width of the first slit and further keep the rail member from coming off the retainer member by accommodating the rail member in the second chamber.

A method for producing a screen apparatus according to the present embodiment includes steps of: extrusion molding a rail member, the rail member including a first chamber and a first slit joining the first chamber; allowing the rail member to hold the screen member movably in a longitudinal direction of the first slit by attaching a fitter member to a side end of a screen member, and accommodating the fitter member and the side end of the screen member passing through the first slit in the first chamber; preparing a retainer member including a second chamber and a second slit joining the second chamber; and accommodating the rail member in the second chamber while allowing the first slit to face the second slit, wherein, in the step of molding the rail member, a width of the wall of the rail member that is formed with the first slit is set to be larger than a width of the second chamber, and a width of the wall of the rail member that is opposite to the wall formed with the first slit is set to be equal to or smaller than the width of the second chamber, and in the step of accommodating the rail member, the wall of the rail member that is formed with the first slit is compressively deformed in a width direction of the first slit in the second chamber to decrease the width of the first slit and thereby render the width of the first slit narrower than a thickness of the fitter member.

The above-described method for producing the screen apparatus makes it possible to easily decrease the width of the first slit in the step of accommodating the rail member in the second chamber by molding the rail member into the specific shape. In this manner, the production process will be simplified. Specifically, in the step of molding the rail member in the method for producing the screen apparatus, the width of the wall of the rail member that is formed with the first slit is set to be larger than the width of the second chamber, and the wall of the rail member that is opposite to the wall formed with the first slit is set to be equal to or narrower than the width of the second chamber. Then, in the step of accommodating the rail member in the second chamber, the wall of the rail member that is formed with the first slit is compressively deformed in the width direction of the first slit in the second chamber. In other words, in the step of accommodating the rail member in the second chamber in the method for producing the screen apparatus, it is possible to realize the accommodating of the rail member in the second chamber and the decreasing in the width of the first slit at the same time. In this manner, the production process will be simplified. Furthermore, in the extrusion molding of the rail member, it is unnecessary to form the first slit having an extremely narrow width. As a result, the rail member can be easily molded.

The invention claimed is:

1. A screen apparatus, comprising:

a screen member;

a fitter member attached to a side end of the screen member;

a rail member including a first chamber surrounded by a first wall portion, and a first slit formed through a surface of the first wall portion to communicate with the first chamber, the first chamber accommodating the fitter member and the side end of the screen member to thereby allow the rail member to hold the screen member movably in a longitudinal direction of the first slit;

a retainer member for retaining the rail member, the retainer member including a second chamber surrounded by a second wall portion to accommodate the rail member, and a second slit formed through the second wall portion along the longitudinal direction of the first slit to communicate with the second chamber and the first slit;

a weight bar attached to a lower end of the screen member in such a manner as to extend along the lower end;

an inner guider having two first side walls and a third chamber defined between the two first side walls to accommodate the retainer member; and an outer guider having two second side walls and a cavity defined between the two second side walls to accommodate the inner guider, wherein the retainer member has a rigidity higher than a rigidity of the rail member, the second wall portion has an inner surface defining the second chamber, the inner surface including a first surface through which the second slit opens, a second surface located opposite to the first surface across the second chamber, and a first lateral surface and a second lateral surface respectively connecting the first surface and the second surface and facing each other across the second chamber, the second chamber has a width set such that the rail member is compressively deformed in a width direction of the first slit by a contact with the first lateral surface and the second lateral surface of the second wall portion, and the second slit has a width larger than a width of the first slit and narrower than a thickness of the fitter member in a state that the rail member is accommodated in the second chamber, the rail member is in contact with each of the first lateral surface and the second lateral surface at a region closer to the first surface, and defines a gap with each of the first lateral surface and the second lateral surface at another region closer to the second surface, and opposite ends of the weight bar are located in the cavity of the outer guider.

* * * * *